United States Patent [19]

Danielson et al.

[11] Patent Number: 4,469,722

[45] Date of Patent: Sep. 4, 1984

[54] REPETITIVE COMBUSTION COATING APPARATUS

[75] Inventors: Glen Danielson; Clyde H. Riley, both of Houston, Tex.

[73] Assignee: H. B. Zachry Company, San Antonio, Tex.

[21] Appl. No.: 422,166

[22] Filed: Sep. 23, 1982

[51] Int. Cl.[3] ..... B05D 1/10

[52] U.S. Cl. ..... 427/423; 118/300; 221/31; 221/74

[58] Field of Search ..... 141/313, 114, 67, 1; 221/31, 74; 427/423; 118/300

[56] References Cited

U.S. PATENT DOCUMENTS

| | | | |
|---|---|---|---|
| 2,637,941 | 5/1953 | Langos | 46/195 |
| 2,639,543 | 5/1953 | Abler | 46/9 |
| 3,340,789 | 9/1967 | Simjian | 99/352 |
| 3,461,268 | 8/1969 | Inoue | 219/76 |
| 3,644,984 | 2/1972 | Inoue | 29/421 |
| 3,744,214 | 7/1973 | Dolce et al. | 53/381 |
| 3,801,346 | 4/1974 | Melton, Jr. et al. | 117/16 |
| 3,893,578 | 7/1975 | Melton, Jr. et al. | 214/305 |
| 3,915,381 | 10/1975 | Melton, Jr. et al. | 239/81 |
| 3,967,761 | 7/1976 | Melton, Jr. et al. | 222/194 |
| 3,974,939 | 8/1976 | Melton, Jr. et al. | 222/1 |
| 4,067,291 | 1/1978 | Park | 118/50 |
| 4,096,945 | 2/1978 | Melton, Jr. et al. | 206/469 |
| 4,366,190 | 12/1982 | Rodden et al. | 427/183 |

*Primary Examiner*—Shrive P. Beck

*Attorney, Agent, or Firm*—Hubbard, Thurman, Turner & Tucker

[57] ABSTRACT

A repetitive combustion coating apparatus for applying coatings of particulate materials such as powdered tungsten carbide and other metal alloys by discharging discrete quantities of material encapsulated in an elongated tape into a combustion chamber and igniting a fuel-air mixture therein to deliver the charge of combustion gases and entrained particulate material through a nozzle to impact the article to be coated. The apparatus includes a rotary indexing wheel over which the encapsulated tape is trained with the spaced apart capsules nested in circumferentially spaced supporting receptacles. The indexing wheel is mounted on support arms which permit limited linear reciprocation so that a ratchet mechanism incrementally indexes the wheel and permits linear movement of the wheel to successively clamp the tape capsules against a clamping die. High pressure gas is introduced through a support spindle for the indexing wheel and internal passages in the wheel to burst a capsule and deliver a charge of particulate material into a combustion chamber. The indexing of the wheel is controlled by a detent mechanism to compensate for dimensional variations in the various structural parts of the apparatus. A control system provides a timed sequence of events to deliver a charge of fuel-air mixture to the combustion chamber as well as a charge of particulate material and ignition of the mixture.

31 Claims, 8 Drawing Figures

REPETITIVE COMBUSTION COATING APPARATUS

BACKGROUND OF THE INVENTION

1. Field of the Invention

The present invention pertains to an apparatus for applying coatings of particulate material to a workpiece by intermittent injection of discrete quantities of material into a combustion chamber and propelling the material through a nozzle entrained with comustion gases for impacting the workpiece.

2. Background Art

In the art of applying coatings of particulate materials to workpieces, methods and apparatus have been developed whereby discrete quantities of material are intermittently injected into a combustion chamber containing a fuel-air mixture, which mixture is ignited to produce heating of the material and propulsion of the material through a nozzle to be impinged on the workpiece. Coatings of powdered tungsten carbide, for example, have been successfully applied to workpieces using an apparatus and method of the general type described in U.S. Pat. No. 3,801,346 to Rosser B. Melton, Jr. et al and U.S. Pat. Nos. 3,893,578; 3,967,761; 3,974,939 and 4,096,945 to Rosser B. Melton, Jr. and Elbert M. Hubbard. These patents pertain to a system wherein an elongated tape is formed to have a plurality of spaced apart discrete capsules, each containing a predetermined quantity of particulate material such as powdered metal alloy. The tape is fed to a stripping device wherein the capsules are clamped and perforated with a jet of high pressure gas to propel the material into a combustion chamber in timed relationship to the ignition of a fuel-air mixture which is also injected into the combustion chamber. The resultant combustion of the mixture heats the particles of material and propels them from the combustion chamber through a nozzle at high velocity for impacting a workpiece to thus form a coating on the workpiece.

As a result of the further developement of a system of the general type described in the aforementioned patents the need for certain improvements has been realized. One problem with the prior art apparatus pertains to the arrangement of the clamping mechanism and the so called inlet and outlet manifolds which clamp and seal the tape around the respectivee capsules so that a jet of high pressure gas may be injected to pierce the tape to inject the particulate material into the combustion chamber. The need to provide an adequate seal around the periphery of the capsule and the need for reliable high speed stripping of the tape resulted in the development of a superior indexing mechanism for positioning and clamping the discrete capsules for subsequent stripping and injection of the material contained therein.

Other desiderata resulting from the development of the general type of apparatus of the present invention include the need for ease of replacement of expendable parts such as the material injection nozzle and the components which clamp the tape during the capsule stripping operation.

The provision of improvements in the tape indexing and stripping mechanism has also resulted in the need for modifications in the timing of the events which result in the delivery of the particulate material to the combustion chamber and the implementation of the combustion process.

The need for improvements in particulate material coating apparatus of the general type described herein has resulted in the present invention which is summarized and described in detail hereinbelow.

SUMMARY OF THE INVENTION

The present invention provides an improved apparatus for applying coatings of particulate material to a workpiece by entraining discrete quantities of the material in a high velocity stream of combustion gases directed against the workpiece. In accordance with one aspect of the present invention there is provided an improved mechanism adapted for stripping discrete quantities of particulate material which are contained in spaced apart capsules on a flexible two-part plastic tape wherein one layer of the tape is pierced by a jet of high pressure gas to pressurize the capsule and burst the opposite tape layer to deliver the material into a combustion chamber containing a mixture of combustible gases.

The improved tape handling and stripping mechanism includes a generally cylindrical tape indexing wheel adapted to receive and support a segment of the tape including a plurality of the spaced apart capsules, and to sequentially clamp the capsules between the indexing wheel and a clamping and sealing die wherein a jet of high pressure gas may then be delivered to burst the capsule and inject the particulate material contained therein into a combustion chamber. The improved indexing mechanism also includes an arrangement whereby the indexing wheel is adapted for reciprocal movement with respect to the clamping die to positively clamp the tape and seal the capsule to prevent escape of particulate material except through the injection nozzle.

In accordance with another aspect of the present invention there is provided a coating apparatus for delivering repetitive charges of particulate material to a combustion chamber and having an improved indexing mechanism for adjusting the indexed position of a cylindrical tape supporting wheel wherein spaced apart capsules on the tape are accurately positioned with respect to a clamping die before the clamping process is initiated.

In accordance with another aspect of the present invention there is provided a repetitive combustion type coating apparatus for particulate material wherein an indexing wheel is provided for supporting a portion of a continuous strip of tape having spaced apart casules of particulate material formed thereon and wherein the indexing wheel has circumferentially spaced insert members which form receptacles for receiving and supporting the capsules before they are presented to a cooperating clamping and sealing die for subsequent bursting of the capsule and stripping of the particulate material contained therein.

In accordance with yet another aspect of the present invention there is provided an arrangement of a mounting frame or support for a repetitive combustion coating apparatus wherein the indexing mechanism and the tape feed mechanism may be removed as a unit from the combustion chamber and may be relocated accurately with respect to the tape clamping die. The tape clamping die is formed as a separable part of the particulate material injection nozzle and both the clamping die and the injection nozzle may be easily removed from the apparatus for servicing or replacement.

The present invention still further provides an improved process of controlling the timing of the operation of a repetitive combustion coating apparatus wherein the delivery of a fuel-air mixture to the combustion chamber together with the performance of functions resulting in the delivery of discrete quantities of particulate material are carried out in a predetermined timed relationship such that an improved coating process is realized.

Those skilled in the art will further appreciate the abovementioned features of the present invention as well as other advantages and superior aspects thereof upon reading the detailed description which follows in conjunction with the drawings.

DESCRIPTION OF THE PREFERRED EMBODIMENT

Figure 1:
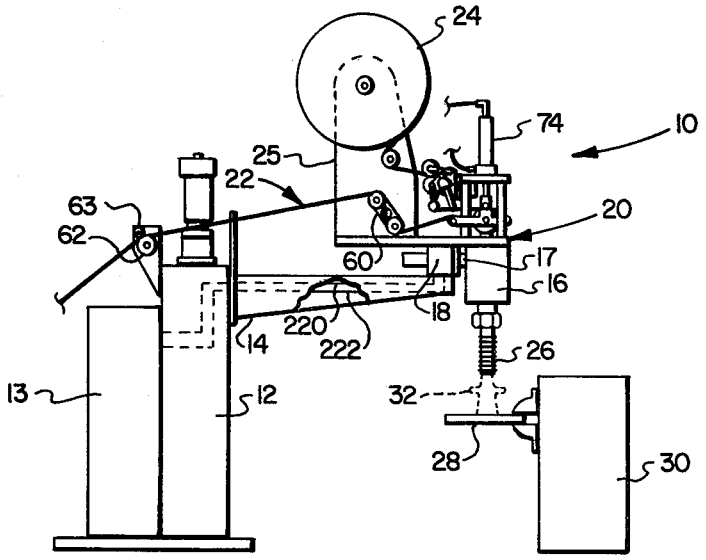
FIG. 1 is a side elevation of a repetitive combustion coating apparatus in accordance with the present invention.

In the description which follows like parts are marked throughout the specification and drawings with the same reference numerals, respectively. The drawings are not necessarily to scale and certain features of the invention may be exaggerated in scale in the interest of clarity and for illustration purposes.

Referring to FIG. 1 there is illustrated a side elevation of a repetitive combustion type coating apparatus which is generally designated by the numeral 10. The apparatus 10 comprises a support base 12 on which a generally horizontally projecting support arm 14 is mounted. The support arm 14 is preferably characterized as an inverted channel shaped member having somewhat tapered sidewalls, as illustratd. The distal end of the support arm 14 is adapted to support structure comprising a combustion chamber, generally designated by the numeral 16 and a carburetor, generally designated by the numeral 18. The combustion chamber 16 and carburetor 18 are suitably secured together by a fuel-air conduit portion 17 and the carburetor 18 is suitably fastened to the distal end of the support arm 14.

Mounted above the combustion chamber 16 and secured thereto is a support frame 20 for apparatus for delivering discrete pulses of particulate material, such as powdered tungsten carbide, to the combustion chamber from spaced apart capsules formed on a continuous strip of filmlike tape. The tape, which is generally designated by the numeral 22, is fed through the aforementioned apparatus on the frame 20 from a supply reel 24 suitably mounted on a support bracket 25 and drivenly connected to suitable dereeling mechanism, not shown. The tape 22 is fed from the reel 24 through an indexing and stripping mechanism to be described hereinbelow and, after stripping of the encapsulated material, the tape is fed to a receiving reel or receptacle, not shown, by feed mechanism including a feed roller 62 and a pressure roller 63 suitably supported on the base member 12. The periodic delivery of discrete quantities of encapsulated particulate material to the combustion chamber 16 is in timed relationship to the introduction of a charge of fuel-air mixture to the combustion chamber and ignition of the mixture to propel the combustion gases, including the entrained material particles, through a discharge nozzle, generally designated by the numeral 26. A workpiece 28 is suitably mounted on a support 30 and is positioned in proximity to the discharge end of the nozzle 26 to receive the high velocity flow stream of gaseous combustion products and heated material particles which impinge on the surface of the workpiece to form a generally uniform and evenly distributed coating. The surface of the workpiece 28 to be coated is preferably positioned in proximity to a shock wave 32, illustrated in FIG. 1, approximately one-half inch downstream of the wave. The frequency of delivery of pulses of combustion gases and entrained material particles is sufficient to promote a substantially standing wave 32 as the combustion gases and entrained material particles exceed sonic velocity upon exiting from the discharge end of the nozzle 26. The rate of discharge of discrete quantities of encapsulated material into the combustion chamber is typically in the range of 2–3 pulses per second.

The apparatus 10 further includes a housing portion 13 adjacent to the base 12 for containing control circuitry and connectors for control lines and fluid lines which may be trained through the channel shaped support arm 14, as shown in FIG. 1, to the mechanism mounted on the distal end of the arm.

Figure 2:
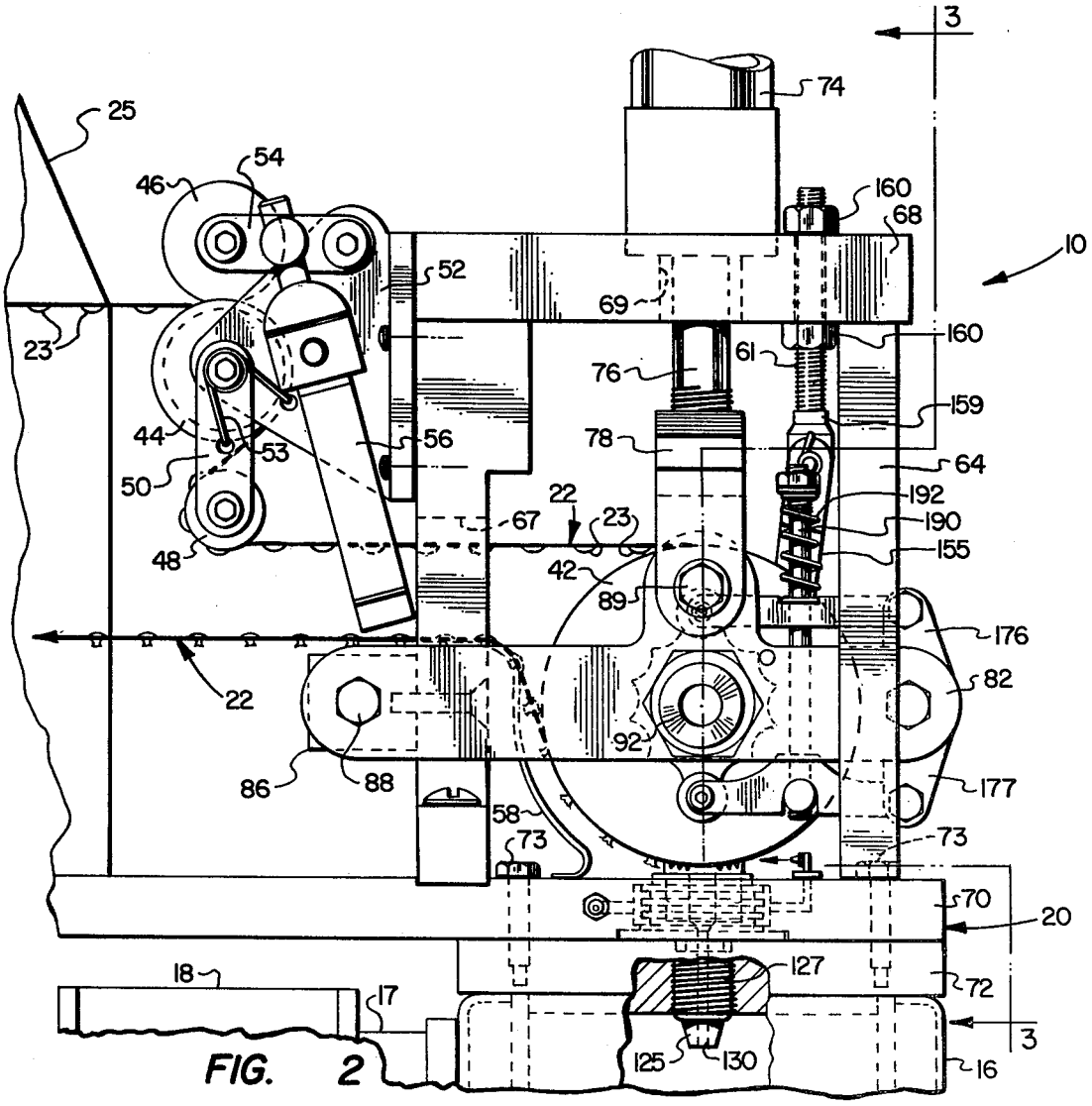
FIG. 2 is a side elevation on a larger scale and illustrating details of the indexing mechanism for the encapsulating tape.
Figure 3:
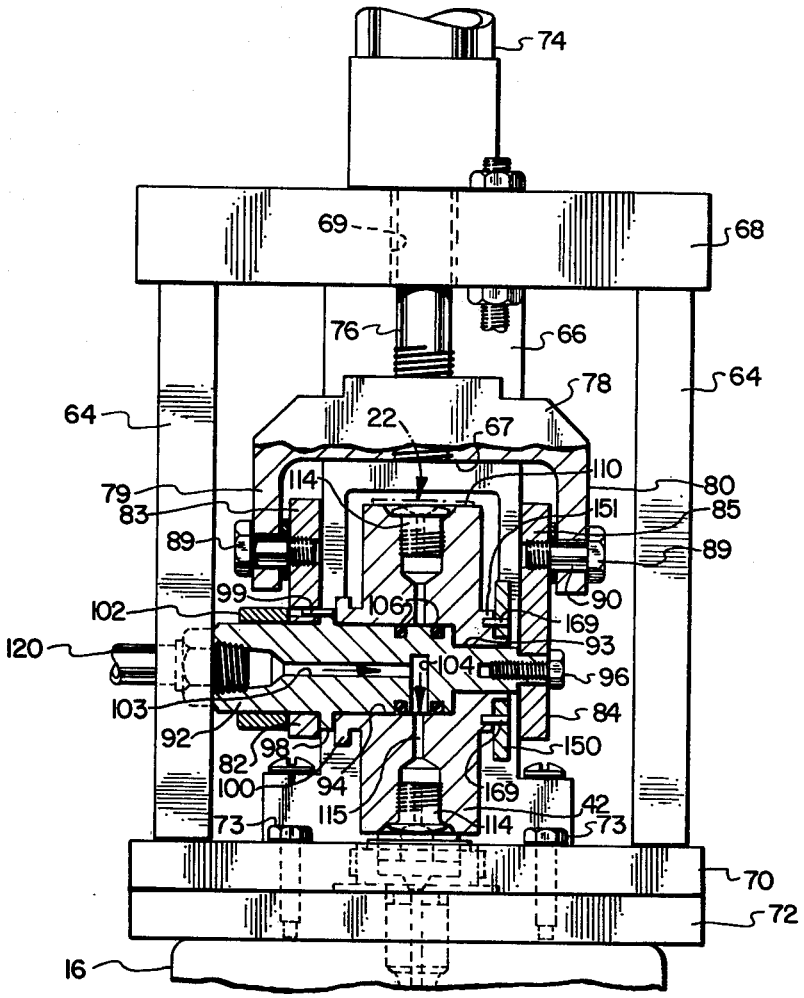
FIG. 3 is a partial section view taken substantially along the line 3—3 of FIG. 2.
Figure 4:
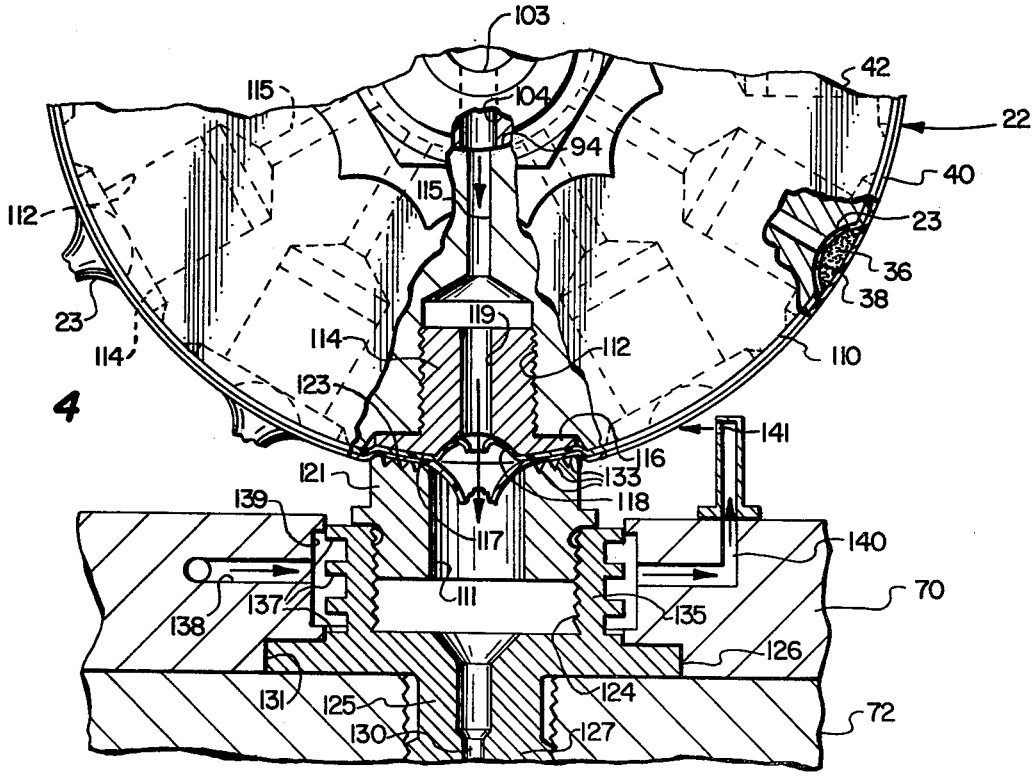
FIG. 4 is a detail side elevation, partially sectioned, of the tape indexing wheel showing the capsule clamping parts.
Figure 7:
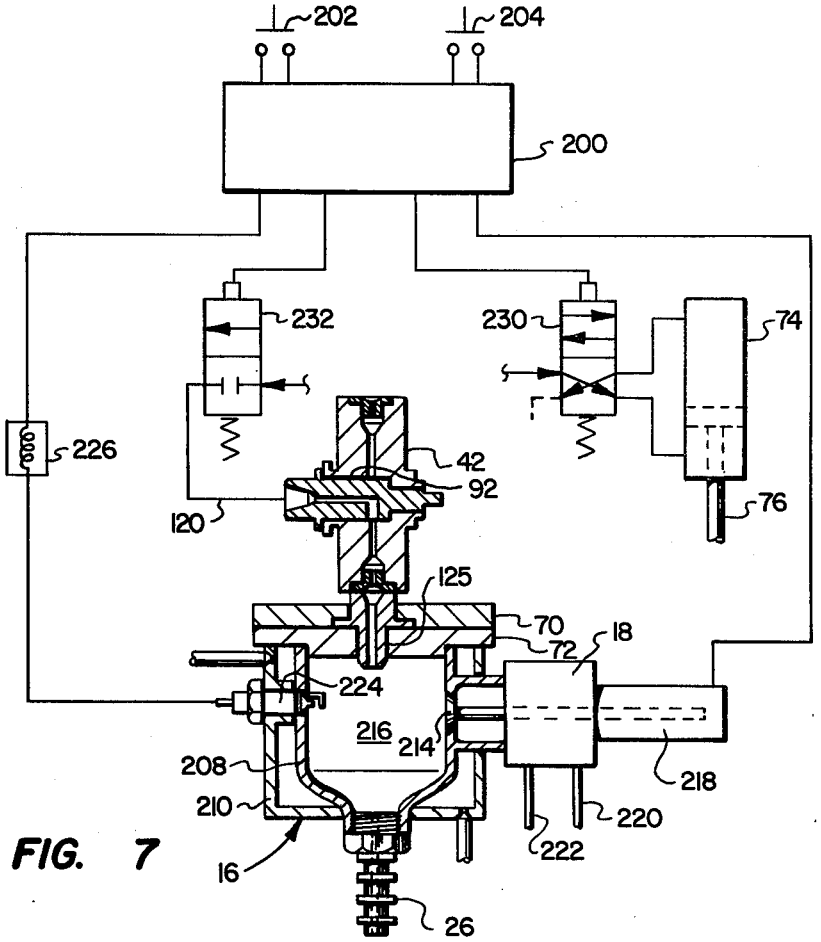
FIG. 7 is a schematic diagram of a portion of the control circuit for the apparatus of the present invention.

Referring now to FIGS. 2 and 3 of the drawings, the apparatus 10 includes improved mechanism for feeding the tape 22 into position wherein the capsules of particulate material may be stripped seriatim and the material injected into the interior of the combustion chamber 16. A schematic diagram of the combustion chamber 16 and the fuel injection system is illustrated in FIG. 7 and is similar in some respects to the combustion chamber and carburetor system disclosed in U.S. Pat. No. 3,893,578. Moreover, the tape 22 is of the type which is provided with spaced apart somewhat hemispherical shaped capsules 23, as illustrated in FIGS. 2 and 4, which are filled with premeasured quantities of particulate material including, for example, powdered tungsten carbide indicated by the numeral 36 in FIG. 4. The encapsulating tape 22 may be formed of a relatively thick elongated plastic film strip 38 which is embossed to form a series of dome shaped pockets comprising a portion of the capsules 23, and a relatively thin facing layer or strip 40 which seals a measured quantity of particulate material 36 in each of the pockets. The top of each capsule 23 may be suitably dimpled to provide a relatively thin section which will yield to be perforated by high pressure gas applied to the surface of the capsule dome and before the dome collapses. The tape 22 may be similar to the tape described in U.S. Pat. No. 3,893,578 and in particular in regard to the tape embodiment described in conjunction with FIGS. 11 through 13 of the patent.

As illustrated in FIG. 2, the tape 22 is trained around a substantial portion of the circumference of a cylindrical indexing and clamping wheel, generally designated by the numeral 42. The tape 22 is passed through a tensioning unit including a main support roller 44, a pressure roller 46 and a tensioning roller 48. The tensioning roller 48 is rotatably mounted on a link 50 which is pivotally connected to a support bracket 52. The link 50 is biased by a torsion coil spring 53 to rotate in a clockwise direction with respect to the bracket 52, viewing FIG. 2. The roller 44 is also rotatably mounted on the bracket 52 and the roller 46 is rotatably mounted on a link 54 pivotally connected to the bracket 52. The link 54 is moved between operative and inoperative positions of the pressure roller 46 by a cylinder type actuator 56. The tape leaving the periphery of the indexing wheel 42 is drawn over a guide plate 58, is trained over spaced apart rollers on a tensioning unit 60, as shown in FIG. 1, and is fed to a reel or other suitable retaining means, not shown, by the motor driven tape feeding unit comprising the feed roller 62 and the idler or pressure roller 63. Accordingly, the tape 22 is pulled around the indexing wheel 42 and is under at least slight tension. The reel 24 is preferably motor driven to pay out tape toward the tensioning unit described above in coordination with the operation of the feed unit.

Referring now to FIGS. 2 and 3, the frame 20 includes two spaced apart vertically extending support columns 64 near the forward edge of the frame and a rear support plate 66 also extending substantially vertically in supportive relationship to a top frame plate 68. The rear support plate 66 includes a recess 67 through which the tape 22 is trained as it approaches and leaves the wheel 42. The members 64 and the plates 66 and 68 are suitably joined together and mounted on a horizontal bottom support plate 70. The support plate 70 is suitably mounted on sub plate 72 by spaced apart threaded fasteners 73. The plate 72 also comprises the head of the combustion chamber 16.

The apparatus 10 also includes a cylinder and piston type actuator, generally designated by the numeral 74, comprising a double acting pneumatic cylinder having a piston with an extensible rod portion 76 extending from the end of the cylinder 74 as shown in the drawing figures. The cylinder actuator 74 is mounted on the frame plate 68 in generally vertically extending orientation and the piston rod 76 projects downward through a bore 69 formed in the frame plate. The distal end of the piston rod 76 is connected to a yoke member 78 having two downwardly projecting spaced apart integral arm portions 79 and 80. The yoke 78 is pivotally connected to spaced apart elongated support arms for the indexing wheel 42 and designated by the numerals 82 and 84, respectively. The arms 82 and 84 are pivotally supported on the rear plate 66 by a support block 86 and by respective support pins 88, one shown in FIG. 2. The arms 82 and 84 each include an upstanding branch part designated by the numerals 83 and 85, respectively, to provide for connecting the arms to the downwardly extending yoke arm portions 79 and 80 as illustrated in FIG. 3. The arms 82 and 84 are pivotally connected to the yoke 78 by bearing means comprising stepped hex head bolts 89 which form a cylindrical bearing surface 90 and which are threadedly engaged with the branch parts 83 and 85. Accordingly, the arms 82 and 84 are adapted for pivotal movement about the pivot axis of the support pins 88 and are also pivotally connected to the yoke 78.

Referring to FIG. 3, the arms 82 and 84 are adapted to support the indexing wheel 42 for rotation on a cylindrical stepped spindle, generally designated by the numeral 92. The spindle 92 includes a portion extending into a cooperating bore 94 formed in the indexing wheel 42 and the spindle further includes a reduced diameter portion 93 extending through a cooperating reduced diameter portion of the bore 94. The end of the spindle 92 adjacent the portion 93 projects through a cooperating bore in the arm 84 and is secured thereto by a bolt 96. The spindle 92 is in close fitting relationship to the bore 94 and includes an annular shoulder 98 disposed adjacent to a detent sprocket portion 100 formed on the index wheel 42. The spindle 92 projects through a cooperting bore in the arm 82 and is secured in assembly therewith by a nut 102 which is engaged with a cooperating threaded portion formed on the spindle. The spindle 92 further includes an elongated central passage 103 extending to a radially projecting passage 104 which extends to the peripheral surface of the portion of the spindle disposed in the bore 94. The shoulder 98 includes a keyway 97 adapted to receive a locating pin 99, see FIG. 5 also, for orienting the spindle in a predetermined rotative position of the passage 104. The pin 99 is suitably mounted on the arm 82. Spaced apart cylindrical o-ring type seals 106 are provided in suitable grooves formed on the periphery of the spindle 92 on each side of the passage 104.

Referring now to FIGS. 3 and 4, the cylindrical indexing wheel 42 has a peripheral outer surface 110 coaxial with the bore 94. A plurality of circumferentially spaced and radially extending threaded bores 112 are formed in the wheel 42 and are adapted to receive respective insert members 114 forming one portion of a clamping die arrangement for engagement with the spaced apart capsules 23 on the tape 22. The bores 112 are coaxial with radially extending passages 115 which intersect the bore 94. The bores 112–115 are substantially laterally centered with respect to the rotational axis of the wheel 42 and, when the wheel is in assembly with the spindle 92, the passages 115 are operable to be in communication with the passage 104, respectively, depending on the rotative position of the wheel 42 with respect to the spindle. As illustrated in FIG. 4 one of the passages 115 is in alignment with the passage 104 in an operative position of the wheel 42 for supplying high pressure gas to burst one of the capsules 23 to strip the encapsulated particulate material trapped therein.

Referring to FIG. 4, each of the insert members 114 includes a circular head portion 116 having a convex spherical surface 117 formed thereon and a coaxial concave spherical receptacle 118 which opens into an axial passage 119 extending through the insert member. The passage 119 is adapted to receive a pulse of high pressure gaseous fluid such as compressed nitrogen from a source, not shown, by way of a conduit 120 connected to the spindle 92, the passages 103–104, the bores 112–115 and the passage 119. Accordingly, when a capsule 23 is nested in a receptacle 118 and clamped against the surface 117 a jet of high pressure gas impinging against the thin walled dimple aligned with the passage 119 will burst the tape layer 38 to flood the interior pocket of the capsule with high pressure gas. Since the exterior surface of the capsule 23 is supported by the wall forming the receptacle 118 the pressure within the interior of the capsule will burst the relatively thin tape layer 40 to strip the encapsulated material 36 from the tape and propel it into a passage 111 formed in a clamping die member 121. The bores 112 and the die inserts 114 disposed therein are, of course, spaced at the peripheral surface of the wheel 42 at the same linear spacing as the centers of the capsules 23. Accordingly, when the tape is trained around the indexing wheel 42, as illustrated in FIGS. 2 and 4, a capsule 23 is nested in the receptacle formed in each of the insert members 114 over which the tape is drawn. The tape may include further support means including sprocket teeth on the peripheral surface of the wheel 42 and cooperating spaced apart openings formed in the tape, not shown. As the wheel 42 is indexed to align each of the insert members 114 to be in registration with the clamping die member 121, the passage 115 associated with that particular insert member is also in registration with the passage 104 in the spindle 92.

Referring further to FIG. 4 the clamping die member 121 is provided with a recess comprising a concave clamping surface 123 having a contour generally complementary to the contour of the convex spherical surface 117. The clamping die 121 also has an externally threaded portion which is adapted to be threadedly engaged with a cooperating internally threaded portion 124 formed in the upper end of an elongated injection nozzle, generally disignated by the numeral 125. The nozzle 125 includes a circular flange 126 adapted to be engaged with the upper surface of the frame or combustion chamber head plate 72. The nozzle member 125 also includes an externally threaded portion 127 which is threadedly engaged with a cooperating internally threaded bore extending through the plate 72 as illustrated in FIG. 2. The nozzle 125 extends downwardly into the interior of the combustion chamber 16, as illustrated, and includes a stepped converging interior passage, generally designated by the numeral 130 in FIG. 4. The periphery of the circular flange portion 126 is adapted to be in close fitting engagement with a cooperable cylindrical recess 131 formed in the bottom side of the frame plate 70 whereby the frame plate 70 and the apparatus supported thereby may be removed from the frame plate 72 and replaced thereon in accurate alignment with the clamping die 121 and the nozzle 125. Accordingly, the flange 126 functions as a pilot member for locating the frame plate 70 with respect to the frame plate 72 and, particularly, for locating the centerline of the indexing wheel 42 with respect to the clamping die 121. The arrangement of the injection nozzle 125 and the separate clamping die member 121 is particularly advantageous since these members require frequent repair or replacement.

Referring again to the structure of the clamping die 121, the surface 123 is formed with a plurality of concentric circular V-shaped grooves 133 which are provided for permitting a minute amount of extrusion of the tape layer 40 into the grooves when the tape is clamped between the surfaces 117 and 123 to assist in gripping and sealing to tape to prevent separation of the film layers due to the pressure of the gas introduced into the interior of the capsules 23. The exterior of a head portion 135 of the nozzle 125 includes a plurality of circumferential grooves 137 which form therebetween fins to permit heat transfer away from the nozzle 125 by cooling air introduced to the fins through a passage 138 formed in the support plate 70. The passage 138 opens into an annular recess 139 to permit communication of cooling air with each of the grooves 137 and flow of cooling air around the periphery of the nozzle head 135 is also provided by a second elongated passage formed diametrically opposite the passage 138. Cooling air leaving the grooves 137 flows through a passage 140 to an outlet nozzle 141 mounted on the support plate 70 adjacent to the indexing wheel 42. The nozzle 141 is directed toward the concave surface of the clamping die 121 to provide for a jet of pressure air to blow away any loose film material or particulate material that might remain on the clamping die after completion of a cycle of stripping a capsule 23.

Figure 5:
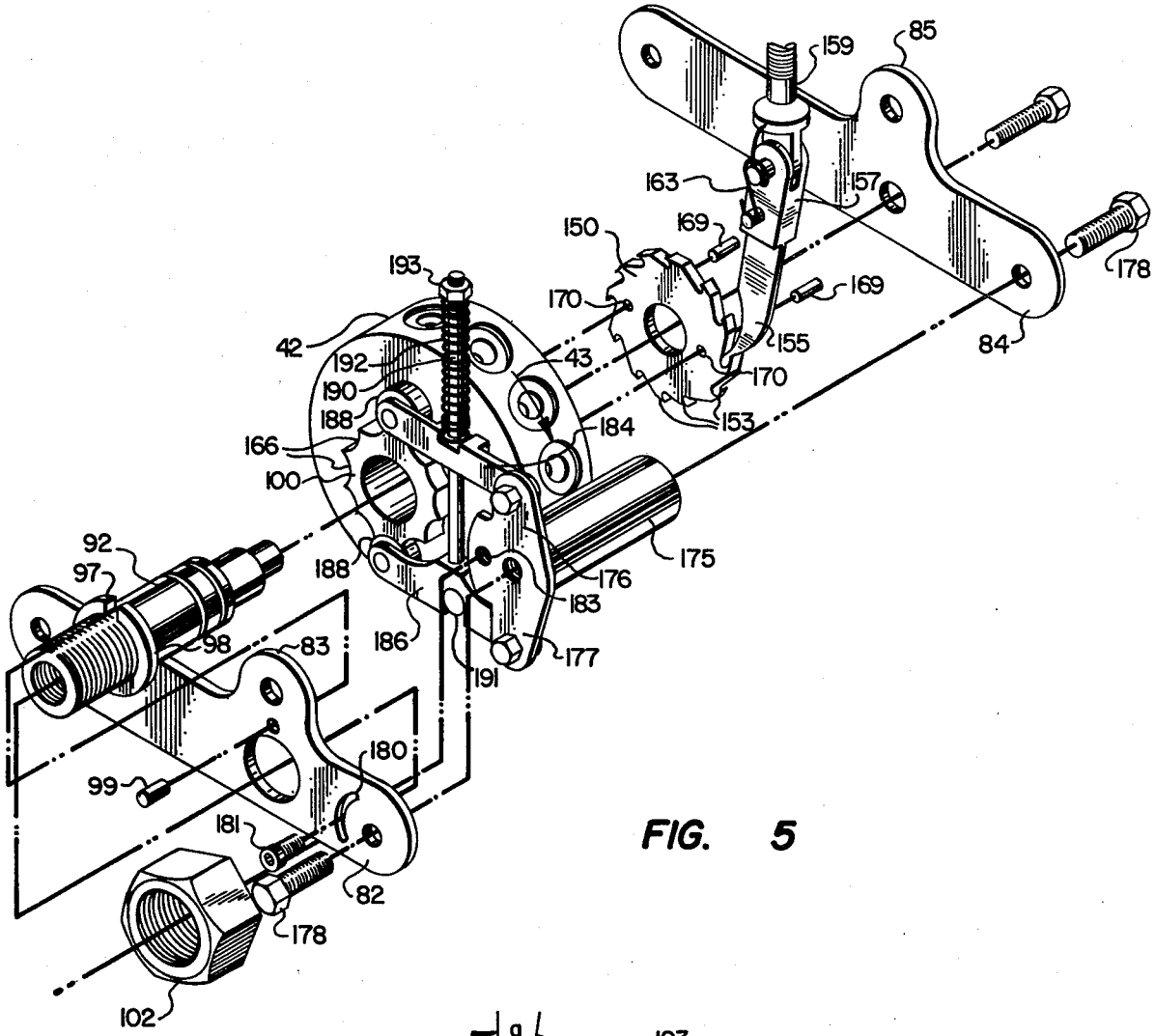
FIG. 5 is an exploded perspective view of the tape indexing wheel including the indexing mechanism and the indexed position adjustment mechanism for adjusting the indexed positions of the wheel and the tape capsules.

The indexing wheel 42 is suitably rotationally indexed in step wise fashion to place the capsules 23 sequentially in position to be stripped of their charge of particulate material by an indexing mechanism which will now be described in detail in conjunction with FIGS. 2 and 5 of the drawings. Referring briefly to FIG. 3 also, the indexing wheel 42 includes a toothed ratchet wheel member 150 which is mounted on an axially projecting hub portion 151 of the indexing wheel, as illustrated. The ratchet wheel 150 includes a plurality of equally spaced, generally radially projecting teeth 153 forming tooth spaces therebetween which are adapted to receive the distal end of a ratchet pawl 155, FIG. 5. The pawl 155 includes a clevis portion 157 which is pivotally mounted on a support rod 159. The rod 159 extends through a cooperating hole in the upper support plate 68 and is secured to the plate by opposed locknuts 160. The support rod 159 includes an externally threaded portion 161 whereby the position of the distal end of the pawl 155 with respect to the ratchet wheel 150 may be adjusted in a generally vertical direction. A torsion coil spring 163 is engaged with the pawl clevis 157 and with the rod 159, as illustrated in FIG. 5, to bias the pawl 155 into the grooves between the ratchet teeth 153. The ratchet teeth 153 are configured to permit seating of the pawl 155 in the grooves formed therebetween to prevent rotation of the ratchet wheel 150 and the indexing wheel 42 in a direction opposite to the arrow 43 shown in FIG. 5.

The ratchet wheel 150 is mounted on the hub of the indexing wheel 42 such that the teeth 153 are aligned in a predetermined relationship with circumferentially spaced detent recesses 166 formed on the periphery of the detent sprocket portion 100. The ratchet wheel 150 may, for example, be suitably aligned in a predetermined relationship with the detent recesses 166 by cylindrical drive pins 169 which are adapted to be inserted in suitable alignment holes 170 in the ratchet wheel 150 and project into cooperating bores formed in the sidewall of the hub of the indexing wheel 42 as shown also in FIG. 3.

Accordingly, upon axial reciprocation of the piston rod 76 from the position shown in FIGS. 2 and 3 in a generally upward direction, the ratchet pawl 155, will effect incremental clockwise rotation of the wheel 42 in the direction of the arrow 43 shown in FIG. 5. As the direction of movement of the piston rod 76 is reversed, that is, in a downward direction, the wheel 42 will not have a tendency to rotate further and the pawl 155 will ride over the surface of a tooth 153 and drop into a groove adjacent to the groove previously occupied by the pawl. On the next cycle of the actuator 74 in indexing wheel 42 will, of course, be incrementally rotated by the ratchet pawl and wheel arrangement as described above.

Figure 6:
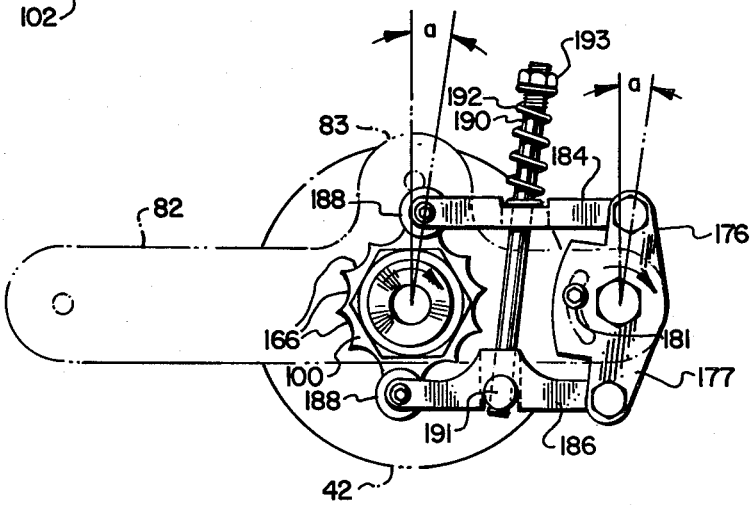
FIG. 6 is a side elevation in somewhat schematic form illustrating the indexed position adjusting mechanism.

The improved mechanism of the coating apparatus 10 also includes means for retaining the indexing wheel 42 in a predetermined position as indexed by the above described ratchet and pawl mechanism and for adjusting the indexed position of the wheel. Referring to FIGS. 2, 5 and 6 the indexing wheel 42 is adapted to be locked in a predetemined position with one of the insert members 114 projecting substantially radially downward in alignment with the clamping die 121 by suitable detent mechanism including a member 175 having oppositely projecting crank arms 176 and 177 on one end thereof. The member 175 is adapted to be supported between the arms 82 and 84 by threaded bolts 178 projecting through the ends of the arms and into cooperating threaded bores formed in the member 175. The arm 82 includes an arcuate slot 180 adapted to receive a fastener 181 which projects into a threaded recess 183 formed in the end portion of the member 175 which includes the crank arms 176 and 177. The crank arms 176 and 177 are pivotally connected to links 184 and 186, respectively, which at their ends opposite the ends connected to the crank arms support respective detent cam rollers 188. The rollers 188 are adapted to nest in the detent recesses 166 formed on the sprocket 100. The arms 184 and 186 are yieldably biased toward each other by linkage means including an elongated rod 190 having a transverse trunnion head 191 suitably nested in a groove formed in the arm 184. The rod 190 projects through a cooperating bore in the arm 184 and through a similar cooperating bore in the arm 186, as illustrated in FIG. 5. A coil spring 192 is interposed between the arm 186 and a retaining nut 193 disposed on a threaded portion of the rod 190 and is operable to yieldably bias the arms 184 and 186 toward each other so that the respective rollers 188 are biased in opposed ones of the recesses 166. Accordingly, the index wheel 42 is suitably retained in a stable and substantially locked position when the rollers 188 are fully seated in the recesses 166 but the arms 184 and 186 may pivot away from each other to permit the wheel 42 to rotate from one indexed position to the next.

The number of recesses 166 typically corresponds to the number of bores 112 and are substantially aligned therewith. However, in view of the dimensional tolerances required for economical manufacture of the several parts of the apparatus as described herein, the precise alignment of the insert members 114 with the clamping die 121 is difficult to obtain in the detented or stabily locked position of the indexing wheel 42. Accordingly, by rotating the member 175 and locking the same in the desired position by the locking fastener 181, the angular locked position of the index wheel 42 may be adjusted as illustrated in FIG. 6. For example, if the dimensional tolerances in the parts of the apparatus described is such that vertical alignment of two opposed recesses 166 will not result in suitably precise alignment of the insert members 114 with the clamping die 121, the crank members 176 and 177 may be rotated to cause the parallelogram formed by the crank members and the arms 184 and 186 to adjust the indexed position of the wheel 42 any incremental angular amount as indicated by the lines defining the angles a in FIG. 6. Moreover, each time the clamping die 121 and/or the nozzle 125 are removed, the alignment of these members with respect to the indexed position of the indexing wheel 42 is effected due to the dimensional tolerances on these parts. Since the clamping die 121 and the nozzle 125 are relatively short life components the provision of the adjustable detent positioning mechanism described and illustrated in FIGS. 5 and 6 is particularly advantageous for the apparatus of the present invention.

The basic operation of the apparatus 10 will now be described in conjunction with the drawing figures. Upon initial assembly of the components of the apparatus and/or replacement of any one of the major components such as the indexing wheel 42, the clamping die 121, or the nozzle 125 the detent position of the indexing wheel 42 and the clamped position of the tape capsules as illustrated in FIGS. 2 and 3 is initially adjusted by rotating the member 175 and locking the member in the desired position which will result in arresting the wheel 42 in the correctly detented or locked position to place the insert members in alignment with the clamping die. The tape 22 is threaded through the path described above and illustrated in the drawings such that the capsules 23 are nested in the receptacles 118 in respective ones of the inserts 114. The spindle 92 is connected to a source of high pressure gas such as nitrogen, not shown, by way of the conduit 120 and having interposed therein a suitable control valve to be described later herein in conjunction with a control circuit illustrated in FIG. 7. Cycling of the cylinder actuator 74 is also controlled in timed relationship to the introduction of pressure fluid into the passageway 103–104 and in timed relationship to the introduction of a charge of fuel-air mixture into the combustion chamber 16 and ignition of said mixture.

In a typical operating cycle of the apparatus 10 with the tape 22 properly threaded through the feed and tensioning units and threaded around and engaged with the indexing wheel 42, the actuator 74 is energized to raise the indexing wheel above the clamping die 121. Upon raising of the actuator piston rod 76 and the structure connected thereto the indexing wheel 42 will be rotatably indexed by the ratchet pawl 155 an annular increment corresponding substantially to the angle between the centerlines of the insert members 114. The precise indexing or positioning of the inserts 114 is, of course, provided by the detent indexing mechanism including the detent sprocket portion 100 and the rollers 188 mounted on the arms 184 and 186. With the wheel 42 indexed to place an unburst capsule 23 in position to be clamped between the insert 114 and the clamping die 121 the cylinder actuator 74 is energized to drive the piston rod 76 downwardly to cause forcible clamping of the tape between the insert 114 and the surface 123 of the clamping die. In this position, as shown in FIG. 4, the tape 22 is squeezed between the surfaces 117 and 123 around the periphery of the capsule 23 to prevent lateral separation of the film strips 38 and 40. Upon complete sealing engagement of the capsule 23 between the insert 114 and the clamping die 121 a timed pulse of high pressure gas is introduced through the passages 103–104 and 115–119 to burst the capsule and deliver a charge of particulate material through the nozzle 125 into the interior of the combustion chamber. Upon bursting of a capsule 123, and in timed relation to the combustion process, the actuator 74 is retracted to raise the indexing wheel 42 thereby effecting incremental rotation of the wheel to position the next capsule for stripping. The actuator 74 is then reversed and the indexing wheel 42 again lowered into clamping engagement of the next capsule 23 between its insert 114 and the clamping die 121.

Referring now to FIG. 7 a diagram of a control circuit for the apparatus 10 is illustrated together with certain components of the apparatus in somewhat schematic form. The timed operation of the actuator 74, the delivery of a charge of fuel-air mixture from the carburetor 18 to the combustion chamber 16, the delivery of a charge of pressure gas to burst a capsule 23 and ignition of the fuel-air mixture in the combustion chamber 16 are performed in a sequence provided by the generation of a set of control signals by a controller generally designated by the numeral 200 in FIG. 7. The controller 200 may include suitable electronic clock circuitry to produce a set of operating signals in a predetermined timed relationship to provide operation of the apparatus. The controller 200 may be set in operation and deenergized by suitable start and stop switches 202 and 204.

FIG. 7 also illustrates in somewhat schematic form the combustion chamber 16 which preferably includes a liner 208 and a water jacket 210. The chamber liner 208 includes a fuel-air mixture inlet port which is adapted to be opened and closed by a poppet type valve 214 to admit a fuel-air mixture into the interior chamber 216. The valve 214 is operable to be opened and closed by a solenoid actuator 218 which is adapted to receive a suitable operating signal from the controller 200. The carburetor 18 may be of the type described in U.S. Pat. No. 3,893,578 and is arranged to have a supply of fuel admitted thereto through a conduit 220 and a supply of compressed air admitted through a conduit 222. One or more suitable ignition plugs 224, one shown, are also mounted on the combustion chamber 16 and receive a pulse of high voltage electricity from a coil 226. The particular details of the carburetor 18 and the ignition circuit, including the spark plug 224 and coil 226, are generally in accordance with the prior art arrangements of repetitive combustion coating apparatus and, forming no part of the present invention per se, do not require further detailed description.

The actuator 74 is preferably controlled by a two position valve, generally designated by the numeral 230. The supply of high pressure gas admitted to the spindle 92 is controlled by way of a two position on/off valve 232. The valves 230 and 232 are preferably solenoid actuated types which are adapted to receive suitable energizing signals from the controller 200.

Figure 8:
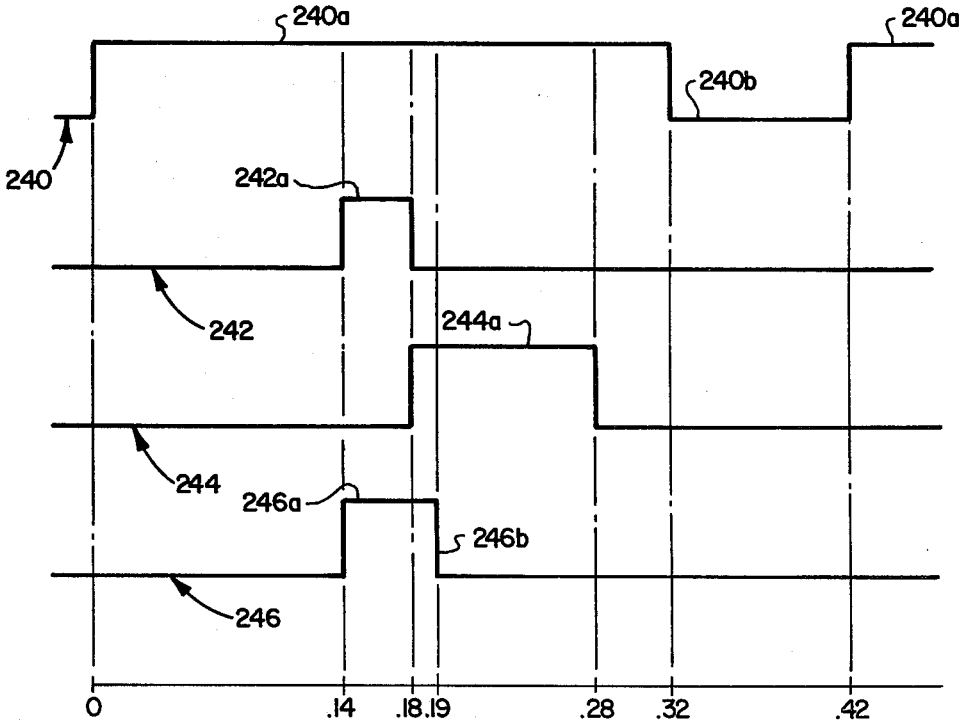
FIG. 8 is a diagram illustrating the timing of events relating to the process of delivering discrete quantities of encapsulated material to the combustion chamber and igniting the combustible mixture contained therein.

Referring also to FIG. 8 there is shown a time-event diagram for the operation of the apparatus 10. The horizontal scale of the diagram of FIG. 8 represents the elapsed time in seconds from the initiation of a controlling event, for example, energization of the actuator 74. The line 240 represents the condition of the actuator 74. The segments **240*a* represent the condition wherein the actuator 74 is extended to clamp a capsule 23 between an insert member 114 and the clamping die 121. The line segment 240*b* represents the condition wherein the actuator 74 is retracted to raise the indexing wheel 42** and provide for its incremental rotation to index the next capsule.

The line 242 represents the condition of the valve 214. The line segment **242*a* indicates the time during which the valve 214 is open or partially opened. The line 244 represents the condition of the valve 232 to deliver bursting gas to burst a capsule 23. The line segment 244*a* indicates the elapsed time during which the valve 232** is opened to deliver a charge of bursting gas through the passageways described above.

The line 246 represents the condition of the ignition circuit including the coil 226, and the line segment **246*a* indicates the initiation and elapsed time during which the coil is being charged and the instance of firing is indicated by the vertical line portion 246*b***.

As may be appreciated viewing FIG. 8 the initiation of the various events comprising the provision of a charge of fuel-air mixture to the interior chamber 216 as well as the delivery of a charge of particulate matter to the chamber are carried out in a predetermined sequence. Assuming that initiation of clamping a capsule 23 with the indexing wheel 42 commences at time zero the opening of the valve 214 and initiation of the ignition sequence is commenced at 0.14 seconds after operation of the actuator 74. The valve 214 should, of course, be closed before the charge of fuel-air is ignited in the combustion chamber and, accordingly, the valve is closed at 0.18 seconds, the same time at which the valve 232 is energized to deliver a pulse of high pressure gas to burst a capsule 23. Accordingly, the delivery of the charge of particulate matter into the interior of the combustion chamber occurs slightly before actual ignition of the fuel-air mixture therein which, for example, may be on the order of 0.01 seconds before ignition. However, in order to assure that a complete charge of particulate matter is delivered to the combustion chamber the valve 232 remains open until an elapsed time of 0.28 seconds from initiation of the entire sequence. The nominal supply pressure of bursting gas is greater than the peak pressure in the chamber 216 and is approximately 800 psig for the apparatus 10. At 0.32 seconds from initiation of a cycle the actuator 74 is energized to retract the indexing wheel and cause incremental rotation thereof between 0.32 and 0.42 seconds elapsed time whereupon a new cycle is commenced. Accordingly, a complete firing cycle may take place in a total elapsed time of approximately 0.42 seconds.

The above described sequence and timing of events for operation of the apparatus 10 have proven to produce superior operating characteristics. Moreover, the improvements in the apparatus as described hereinabove are also believed to be superior to devices of a similar type previously known. Those skilled in the art will appreciate that various substitutions and modifications may be made to the embodiment of the invention described without departing from the scope and spirit of the invention as recited in the appended claims.

What is claimed is:

1. Apparatus for coating articles with a coating of particulate material entrained in a stream of combustion gases wherein discrete quantities of said material are provided in spaced apart capsules formed on a flexible tape, and said capsules are stripped seriatim to inject said quantities of material into a combustion chamber, said apparatus comprising:

means forming a combustion chamber for receiving a combustible substance operable to generate combustion gases;

an injection nozzle in communication with said combustion chamber for injecting quantities of particulate material into said combustion chamber;

an exit nozzle in communication with said combustion chamber for delivering a stream of combustion gases and entrained particulate material to impinge a workpiece;

support means;

an indexing wheel mounted on said support means and engageable with a portion of said tape;

a clamping die including passage means in communication with said injection nozzle;

means for effecting limited reciprocal movement of said indexing wheel between a retracted position and a position for clamping said tape between said indexing wheel and said clamping die;

means for effecting rotary movement of said indexing wheel in response to said reciprocal movement to position successive ones of said capsules in position to be clamped between said indexing wheel and said clamping die; and means for delivering high pressure gas to burst each of said capsules when said capsules are positioned between said indexing wheel and said clamping die for stripping said capsules of said particulate material and injecting said particulate material into said combustion chamber.

2. The apparatus set forth in claim 1 wherein:

said indexing wheel includes means forming a plurality of circumferentially spaced receptacles for receiving a plurality of said capsules on said tape, respectively, and passage means opening into respective ones of said receptacles for conducting a pulse of high pressure gas to burst said capsules to discharge particulate material through cooperating passage means in said clamping die.

3. The apparatus set forth in claim 2 wherein:

said receptacles are formed on respective circumferentially spaced insert members mounted on said indexing wheel.

4. The apparatus set forth in claim 3 wherein:

said receptacles are formed to have a concave surface corresponding substantially to the shape of said capsules.

5. The apparatus set forth in claim 2 wherein:

said means forming said receptacles include convex surface portions formed around said receptacles cooperable with a corresponding concave surface on said clamping die for clamping a portion of said tape surrounding said capsule to form a pressure seal.

6. The apparatus set forth in claim 1 wherein: said indexing wheel is rotatably mounted on a spindle, said spindle including a radially extending passage adapted to be in registry with successive ones of a plurality of radially extending passages in said indexing wheel in communication with respective ones of said capsules on said portion of said tape.

7. The apparatus set forth in claim 1 wherein:

said means for effecting reciprocal movement of said indexing wheel includes an actuator disposed on said support means and operable to move said indexing wheel between said retracted position and said position for clamping said tape.

8. The apparatus set forth in claim 1 or 7 wherein:

said apparatus includes detent means for holding said indexing wheel in a predetermined rotative position in response to said indexing.

9. The apparatus set forth in claim 7 wherein:

said spindle is mounted on a pair of spaced apart arms pivotally connected to said support means, and said actuator comprises a pressure fluid cylinder and piston actuator mounted on said support means and connected to said arms for pivotally moving said arms to effect reciprocal movement of said indexing wheel.

10. The apparatus set forth in claim 1 wherein:

said injection nozzle comprises a separate part removably mounted on support means providing for communication of said injection nozzle with the interior of said combustion chamber.

11. The apparatus set forth in claim 10 wherein:

said clamping die comprises a separate part threadedly engaged with and supported on said injection nozzle.

12. The apparatus set forth in claim 10 wherein:

said injection nozzle includes locating surface means thereon, and said support means includes a frame part for supporting said indexing wheel and cooperable with said locating surface on said injection nozzle for locating said frame part and said indexing wheel with respect to said clamping die.

13. The apparatus set forth in claim 1 wherein:

said clamping die includes a spherical concave surface cooperable with means forming a spherical convex surface on said indexing wheel for clamping a portion of said tape surrounding a capsule during the stripping of said capsule, and said clamping die includes tape gripping and sealing means formed on said concave surface for sealing pressure gases from escaping from said capsule around the periphery of said clamping die.

14. Apparatus for coating articles with a coating of particulate material entrained in a stream of combustion gases wherein discrete quantities of said material are provided in spaced apart capsules formed on a flexible tape, and said capsules are stripped seriatim to inject said quantities of material into a combustion chamber, said apparatus comprising:

means forming a combustion chamber for receiving a combustible substance operable to generate combustion gases;

an injection nozzle for injecting quantities of particulate material into said combustion chamber, a subframe including support plate means for supporting said injection nozzle as a separate part on said subframe and removable from said support plate means and providing for communication of said injection nozzle with the interior of said combustion chamber;

an exit nozzle in communication with said combustion chamber for delivering a stream of combustion gases and entrained particulate material to impinge a workpiece;

a support frame;

a clamping die including passage means in communication with said injection nozzle;

tape clamping means mounted on said support frame for clamping successive ones of said capsules against said clamping die; and said injection nozzle includes locating surface means thereon, and said support frame includes a frame part for supporting said clamping means and including surface means cooperable with said locating surface on said injection nozzle for locating said frame part with respect to said injection nozzle whereby said support frame and said clamping means can be removed from and reassembled to said subframe as a subassembly while providing for alignment of said clamping means with said clamping die.

15. The apparatus set forth in claim 14 wherein:

said clamping die comprises a separate part supported on said injection nozzle.

16. The apparatus set forth in claim 14 wherein said injection nozzle includes a head portion for supporting said clamping die, and said frame part includes means for conducting a flow of cooling fluid to said head portion to cool said head portion.

17. Apparatus for coating articles with a coating of particulate material entrained in a stream of combustion gases wherein discrete quantities of said material are provided in spaced apart capsules formed on a flexible tape, and said capsules are stripped seriatim to inject said quantities of material into a combustion chamber, said apparatus comprising:

means forming a combustion chamber for receiving a combustible substance operable to generate combustion gases;

an injection nozzle for injecting quantities of particulate material into said combustion chamber;

an exit nozzle in communication with said combustion chamber for delivering a stream of combustion gases and entrained particulate material to impinge a workpiece;

support means;

an indexing wheel mounted on said support means and engageable with a portion of said tape;

a clamping die including passage means in communication with said injection nozzle;

means for effecting rotary indexing movement of said indexing wheel to position successive ones of said capsules between said indexing wheel and said clamping die;

adjustable detent means for holding and indexing wheel in a predetermined rotative position in response to said indexing; and means for delivering high pressure gas to burst each of said capsules when said capsules are positioned between said indexing wheel and said clamping die for stripping said capsules of said particulate material and injecting said particulate material into said combustion chamber.

18. The apparatus set forth in claim 17 wherein:

said detent means includes a plurality of circumferentially spaced recesses formed on sprocket means on said indexing wheel and cam means yieldably engageable with said sprocket means for seating in respective ones of said recesses in response to rotation of said indexing wheel.

19. The apparatus set forth in claim 18 wherein:

said cam means includes means for adjusting the position of said cam means with respect to the axis of rotation of said indexing wheel whereby the rotative indexed position of said indexing wheel may be adjusted to align said capsules with said clamping die.

20. The apparatus set forth in claim 19 wherein:

said cam means includes a pair of opposed cam rollers, each of said rollers being mounted on an arm, each of said arms being pivotally connected to a crank link adapted to be rotatably positioned on support means for said indexing wheel whereby said rollers may be adjustably positioned to control the rotative indexed position of said indexing wheel.

21. The apparatus set forth in claim 20 further including:

means interconnecting said arms including spring means for biasing said arms toward each other to maintain said cams engaged with said recesses in said sprocket means.

22. A method for operating a repetitive combustion coating apparatus for delivering discrete quantities of particulate material entrained in a stream of combustion gases to a work piece, said apparatus comprising means forming a combustion chamber, means for introducing a fuel-air mixture into said combustion chamber including a first valve operable to be opened to admit said mixture to said combustion chamber, means for successively positioning a plurality of spaced apart capsules formed on an encapsulating tape, said capsules each including premeasured quantities of particulate material, actuating means for said positioning means, a second valve for controlling the delivery of high pressure gas to said positioning means to burst a capsule to inject the particulate material encapsulated by said tape into said combustion chamber, ignition means for ingniting said mixture, and control means for providing control signals to operate said first and second valves, said actuating means and said ignition means: said method including the steps of:

actuating said positioning means to position one of said capsules for injection of a quantity of particulate material into said combustion chamber;

producing signals with said control means to sequentially open said first valve to admit a flow of said mixture to said combustion chamber when said capsule is positioned for stripping and substantially simultaneously close said first valve and open said second valve to admit pressure gas to burst said capsule in position to be stripped, and igniting said mixture in said combustion chamber after commencement of the admission of pressure gas to burst said capsule while continuing to admit pressure gas to strip said material from said capsule;

ceasing the admittance of pressure gas after a predetermined time period; and actuating said positioning means to place another capsule in position for stripping said particulate material.

23. The method set forth in claim 22 wherein:

said step of igniting said mixture includes initiating a signal to said ignition means at a predetermined time to assure that the onset of ignition of said mixture will occur after said second valve is opened.

24. Apparatus for coating articles with a coating of particulate material entrained in a stream of combustion gases wherein discrete quantities of said material are provided in spaced apart capsules formed on a flexible tape, and said capsules are stripped seriatim to inject said quantities of material into a combustion chamber, said apparatus comprising:

means forming a combustion chamber for receiving a combustible substance operable to generate combustion gases;

an injection nozzle in communication with said combustion chamber for injecting quantities of particulate material into said combustion chamber;

an exit nozzle in communication with said combustion chamber for delivering a stream of combustion gases and entrained particulate material to impinge a workpiece;

support means;

an indexing wheel mounted on said support means and engageable with a portion of said tape;

a clamping die including passage means in communication with said injection nozzle;

means for effecting limited reciprocal and rotary movement of said indexing wheel including means responsive to reciprocal movement of said indexing wheel to rotatably index said indexing wheel and comprising a plurality of circumferentially spaced ratchet teeth on said indexing wheel, a ratchet pawl on said support means engageable with said ratchet teeth and operable in response to reciprocal movement of said indexing wheel to effect incremental rotation of said indexing wheel sufficient to successively position adjacent capsules on said tape in position to be clamped between said indexing wheel and said clamping die; and means for delivering high pressure gas to burst each of said capsules when said capsules are positioned between said indexing wheel and said clamping die for stripping said capsules of said particulate material and injecting said particulate material into said combustion chamber.

25. Apparatus for coating articles with a coating of particulate material entrained in a stream of combustion gases wherein discrete quantities of said material are provided in spaced apart capsules formed on a flexible tape, and said capsules are stripped seriatim to inject said quantities of material into a combustion chamber, said apparatus comprising:

means forming a combustion chamber for receiving a combustible substance operable to generate combustion gases;

an injection nozzle in communication with said combustion chamber for injecting quantities of particulate material into said combustion chamber;

an exit nozzle in communication with said combustion chamber for delivering a stream of combustion gases and entrained particulate material to impinge a workpiece;

support means;

an indexing wheel mounted on said support means and engageable with a portion of said tape;

a clamping die including passage means in communication with said injection nozzle;

means for effecting limited reciprocal and rotary movement of said indexing wheel including an actuator disposed on said support means and operable to move said indexing wheel between a retracted position and a clamping position with respect to said clamping die and means responsive to reciprocal movement of said indexing wheel to rotatably index said indexing wheel including a plurality of circumferentially spaced ratchet teeth on said indexing wheel, a ratchet pawl on said support means engageable with said ratchet teeth and operable in response to reciprocal movement of said indexing wheel to effect incremental rotation of said indexing wheel sufficient to successively position adjacent capsules on said tape in position to be clamped between said indexing wheel and said clamping die; and means for delivering high pressure gas to burst each of said capsules when said capsules are positioned between said indexing wheel and said clamping die for stripping said capsules of said particulate material and injecting said particulate material into said combustion chamber.

26. Apparatus for coating articles with a coating of particulate material entrained in a stream of combustion gases wherein discrete quantities of said material are provided in spaced apart capsules formed on a flexible tape, and said capsules are stripped seriatim to inject said quantities of material into a combustion chamber, said apparatus comprising:

means forming a combustion chamber for receiving a combustible substance operable to generate combustion gases;

an injection nozzle in communication with said combustion chamber for injecting quantities of particulate material into said combustion chamber;

an exit nozzle in communication with said combustion chamber for delivering a stream of combustion gases and entrained particulate material to impinge a workpiece;

support means;

an indexing wheel mounted on said support means and engageable with a portion of said tape;

a clamping die including passage means in communication with said injection nozzle;

means for effecting limited reciprocal and rotary movement of said indexing wheel comprising means responsive to reciprocal movement of said indexing wheel to rotatably index said indexing wheel to position successive ones of said capsules on said tape in position to be clamped between said indexing wheel and said clamping die, and detent means for holding said indexing wheel in a predetermined rotative position in repsonse to said indexing including a plurality of circumferentially spaced recesses formed on sprocket means on said indexing wheel and cam means yieldably engageable with said sprocket means for seating in respective ones of said recesses in response to rotation of said indexing wheel; and means for delivering high pressure gas to burst each of said capsules when said capsules are positioned between said indexing wheel and said clamping die for stripping said capsules of said particulate material and injecting said particulate material into said combustion chamber.

27. Apparatus for coating articles with a coating of particulate material entrained in a stream of combustion gases wherein discrete quantities of said material are provided in spaced apart capsules formed on a flexible tape, and said capsules are stripped seriatim to inject said quantities of material into a combustion chamber, said apparatus comprising:

means forming a combustion chamber for receiving a combustible substance operable to generate combustion gases;

an injection nozzle in communication with said combustion chamber for injecting quantities of particulate material into said combustion chamber;

an exit nozzle in communication with said combustion chamber for delivering a stream of combustion gases and entrained particulate material to impinge a workpiece;

support means;

an indexing wheel mounted on said support means and engageable with a portion of said tape;

a clamping die including passage means in communication with said injection nozzle;

means for effecting limited reciprocal and rotary movement of said indexing wheel including an actuator disposed on said support means and operable to move said indexing wheel between a retracted position and a clamping position with respect to said clamping die, means responsive to reciprocal movement of said indexing wheel to rotatably index said indexing wheel to position successive ones of said capsules on said tape in position to be clamped between said indexing wheel and said clamping die, and detent means for holding said indexing wheel in a predetermined rotative position in response to said indexing including a plurality of circumferentially spaced recesses formed on sprocket means on said indexing wheel and cam means yieldably engageable with said sprocket means for seating in respective ones of said recesses in response to rotation of said indexing wheel; and means for delivering high pressure gas to burst each of said capsules when said capsules are positioned between said indexing wheel and said clamping die for stripping said capsules of said particulate material and injecting said particulate material into said combustion chamber.

28. The apparatus set forth in claim 26 or 27 wherein:

said cam means includes means for adjusting the position of said cam means with respect to the axis of rotation of said indexing wheel whereby the rotative indexed position of said indexing wheel may be adjusted to align said capsules with said clamping die.

29. The apparatus set forth in claim 28 wherein:

said cam means includes a pair of opposed cam rollers, each of said rollers being mounted on an arm, each of said arms being pivotally connected to a crank link adapted to be rotatably positioned on support means for said indexing wheel whereby said rollers may be adjustably positioned to control the rotative indexed position of said indexing wheel.

30. The apparatus set forth in claim 29 further including:

means interconnecting said arms including spring means for biasing said arms toward each other to maintain said cams engaged with said recesses in said sprocket means.

31. Apparatus for coating articles with a coating of particulate material entrained in a stream of combustion gases wherein discrete quantities of said material are provided in spaced apart capsules formed on a flexible tape, and said capsules are stripped seriatim to inject said quantities of material into a combustion chamber, said apparatus comprising:

means forming a combustion chamber for receiving a combustible substance operable to generate combustion gases;

an injection nozzle in communication with said combustion chamber for injecting quantities of particulate material into said combustion chamber;

an exit nozzle in communication with said combustion chamber for delivering a stream of combustion gases and entrained particulate material to impinge a workpiece;

support means;

an indexing wheel mounted on said support means and engageable with a portion of said tape; and a clamping die including passage means in communication with said injection nozzle and a concave surface cooperable with means forming a convex surface on said indexing wheel for clamping a portion of said tape surrounding a capsule during the stripping of said capsule, and a plurality of concentric circular grooves formed in said concave surface for gripping said tape and for sealing pressure gases from escaping from said capsule around the periphery of said clamping die.

* * * * *